US008191848B2

(12) United States Patent
McLoughlin et al.

(10) Patent No.: US 8,191,848 B2
(45) Date of Patent: Jun. 5, 2012

(54) AIR TANK BRACKET WITH STRAP-SUPPORTING ARMS

(76) Inventors: John E. McLoughlin, Hauppage, NY (US); Neocles G. Athanasiades, East Setauket, NY (US); Kiam Meng Toh, St. James, CA (US)

( * ) Notice: Subject to any disclaimer, the term of this patent is extended or adjusted under 35 U.S.C. 154(b) by 0 days.

(21) Appl. No.: 12/794,758

(22) Filed: Jun. 6, 2010

(65) Prior Publication Data

US 2011/0298251 A1 Dec. 8, 2011

(51) Int. Cl.
*A47K 1/08* (2006.01)

(52) U.S. Cl. ..... 248/313; 297/188.04

(58) Field of Classification Search ..... 248/313, 248/311.2, 316.7; 297/188.04, 483, 484, 297/481

See application file for complete search history.

(56) References Cited

U.S. PATENT DOCUMENTS 3,191,828 A * 6/1965 Senne ..... 224/604
3,547,391 A * 12/1970 Johnson ..... 248/311.3
4,599,965 A * 7/1986 Johnson ..... 116/209
5,362,022 A * 11/1994 McLoughlin et al. ..... 248/313
5,681,080 A * 10/1997 Pond et al. ..... 297/188.05
5,934,749 A * 8/1999 Pond et al. ..... 297/188.04
6,220,557 B1 4/2001 Ziaylek et al.
6,543,736 B2 4/2003 Field
6,702,242 B1 3/2004 Ziaylek, Jr. et al.
6,830,226 B2 12/2004 Field et al.
6,926,243 B1 8/2005 Ziaylek et al.
7,503,535 B2 3/2009 Ziaylek
2003/0038525 A1* 2/2003 Pond et al. ..... 297/452.29

* cited by examiner

*Primary Examiner* — Amy Sterling
*Assistant Examiner* — Erin W Smith
(74) *Attorney, Agent, or Firm* — Louise S. Heim

(57) ABSTRACT

A bracket assembly for detachably retaining a body-carried device such as a self-contained breathing apparatus (SCBA) is provided with strap-supporting arms for holding the shoulder straps of the device in a ready-to-wear position. At least a portion of each arm is movable from a generally horizontal, load-bearing or "working" position to a generally vertical, out-of-the-way or "rest" position. A spring or other resilient member urges the movable portion of each arm to the rest position, so the arms do not present a safety hazard to personnel in the area after the body-carried device has been removed from the bracket assembly.

7 Claims, 2 Drawing Sheets

AIR TANK BRACKET WITH STRAP-SUPPORTING ARMS

BACKGROUND

1. Field of the Invention

This invention relates to the field of brackets and mounting devices.

More particularly, the invention relates to a bracket assembly for holding a firefighter's air tank.

In a further and more specific aspect, the invention concerns an air tank bracket assembly having means for holding the straps of a firefighter's air tank harness in a ready-to-wear position and for quickly releasing the straps when the firefighter is ready to deploy.

2. Description of the Prior Art

It is standard procedure to outfit a firefighter or other rescue worker with a self-contained breathing apparatus (SCBA) allowing him to breathe normally in a smoke-filled building. The SCBA typically consists of a face mask connected to a cylindrical air tank or bottle that the firefighter carries on his back using a harness having shoulder and hip or waist straps.

Various types of brackets are available for holding the SCBA when it is not in use. The simplest type consists merely of a pair of C-shaped clamps extending from an elongated back plate, with a foot plate extending from the lower end of the back plate to support the neck of the air tank. However, numerous modifications have been made to the basic design over the years, primarily with the intention of reducing the amount of time needed for the firefighter to remove the SCBA from the bracket and strap it on his back. One major improvement has been to incorporate brackets into the seats of the fire truck so that firefighters can start strapping the SCBA while they are still en route to the fire. Other innovations have included quick-release latches, tangle-resistant restraining straps, adjustable clamps, and ejection devices. Examples of these and other types of improvements can be seen in U.S. Pat. No. 6,543,736 to Field, U.S. Pat. No. 6,830,226 to Field et al., U.S. Pat. Nos. 6,220,557 and 6,926,243 to Ziaylek et al., U.S. Pat. No. 6,702,242 to Ziaylek, Jr. et al., and U.S. Pat. No. 7,503,535 to Ziaylek.

Of particular interest is the tank bracket disclosed in U.S. Pat. No. 5,362,022 to McLoughlin et al, which includes strap-lifting arms coupled to opposite ends of a crossbar that extends horizontally across the top end of the bracket's back plate. Each arm is mounted for pivoting movement from a lowered position parallel to the sides of the back plate to a raised position perpendicular to the back plate. A slit, loop, or other retaining means is provided at the end of each arm for grasping one of the shoulder straps of the SCBA harness, so that when the arms are in the raised position they extend the straps outwardly, away from the bracket and each other, making it easier for the firefighter to slip his arms through the harness.

Although the strap-lifting arms shown in the McLoughlin et al. '022 patent can save a firefighter valuable time, they can present a safety hazard if they are not returned to the lowered position after the SCBA has been removed. Specifically, firefighters may injure themselves by bumping into or brushing against the outwardly projecting arms while they are rushing around in the relatively cramped quarters of the fire truck. Accordingly, there exists a need for a safer tank bracket assembly that allows a firefighter to slip his arms though the straps of an SCBA as quickly as possible, without impeding or obstructing the firefighter's movement in any way.

SUMMARY OF THE INVENTION

Briefly, to achieve the desired objects of the present invention in accordance with the preferred embodiment thereof, a bracket assembly is provided with strap-supporting arms that maintain the straps of a body-carried device in a ready-to-wear position while a firefighter or other rescue worker prepares to deploy, and then quickly move out of the worker's way once the tank is lifted from the bracket.

In a preferred embodiment, the bracket assembly comprises a base member residing within a hollow seat back in an emergency vehicle. A least one clip for detachably retaining the tank of an SCBA projects outwardly from the base member. Strap-supporting arms are provided on opposite sides of the bracket assembly, with at least a portion of each arm being mounted for movement from a rest position generally parallel to the base member to a working position generally perpendicular to the base member. Biasing means are provided for urging the movable portion of each arm toward the rest position, so that arms are normally out of the way of workers entering or exiting the vehicle. However, when the straps of the SCBA harness are looped over the ends of the arms, the weight of the SCBA overcomes the force exerted by the biasing means, causing the movable portion of each arm to move into the working position and remain there until the SCBA is removed.

BRIEF DESCRIPTION OF THE DRAWINGS

The foregoing and more specific objects and advantages of the instant invention will become readily apparent to those skilled in the art from the following detailed description of the preferred embodiments thereof taken in conjunction with the drawings in which.

DETAILED DESCRIPTION OF THE PREFERRED EMBODIMENT

Figure 1:
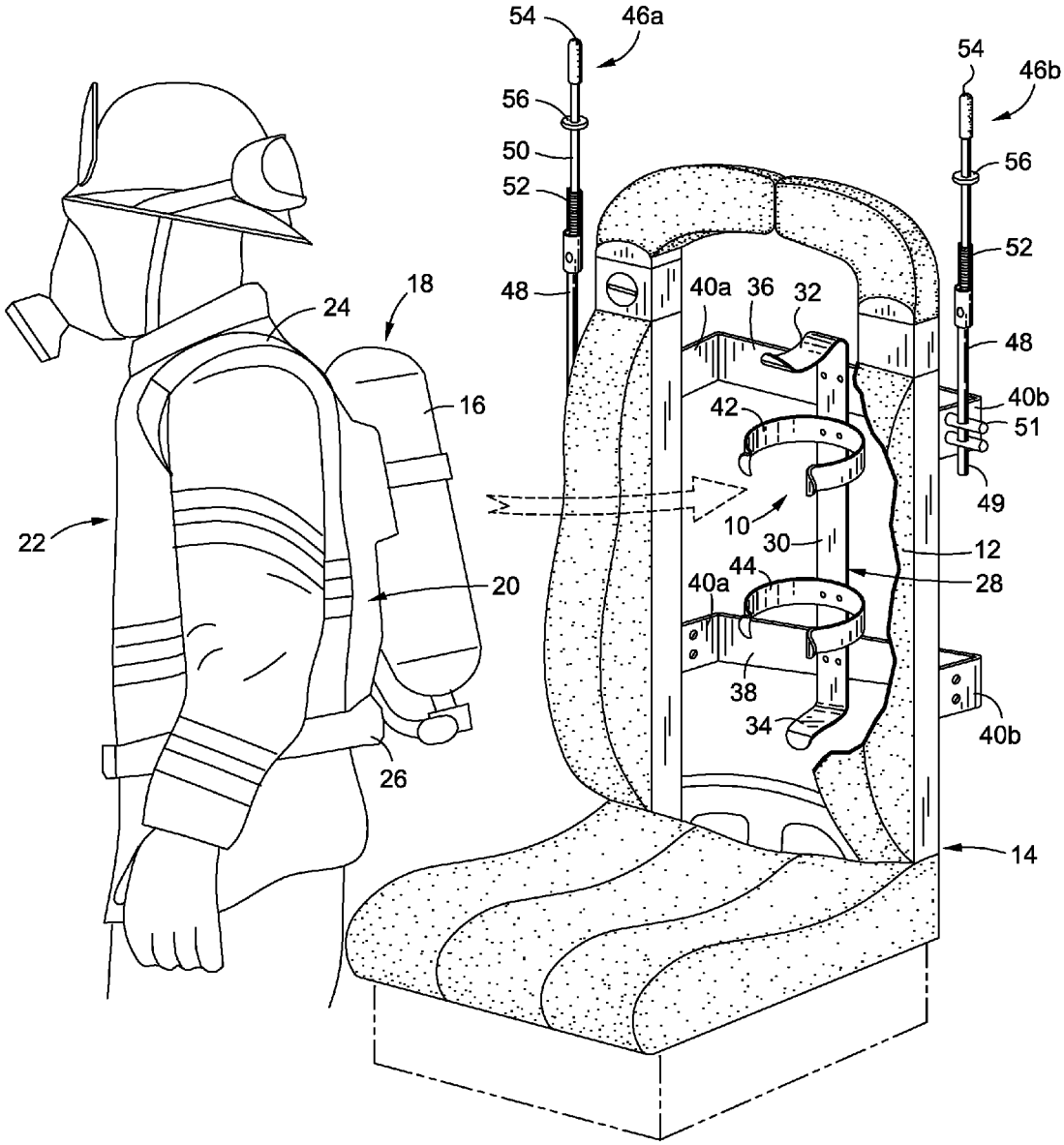
FIG. 1 is a perspective view showing a seat of vehicle with a portion broken away to show the bracket assembly of the present invention, with the strap-supporting arms in a rest position.

Turning now to the drawings in which like reference characters refer to corresponding elements throughout both views, attention is first directed to FIG. 1, which shows the bracket assembly of the present invention, indicated in its entirety by the numeral 10, incorporated into the back 12 of a seat 14 in an emergency vehicle such as a fire truck (not shown). The bracket assembly 10 is configured to detachably retain the cylindrical air tank 16 of a self-contained breathing apparatus (SCBA) 18 that is mounted on a harness 20 worn by a firefighter or other emergency worker 22. The harness includes shoulder straps 24 and a belt 26.

The bracket assembly 10 includes a base member 28 consisting of an elongated, vertically extending central portion that defines a back plate 30 and end portions that are bent forwardly at right angles with respect to the back plate, defining top and bottom plates 32 and 34, respectively. The back plate 30 is held in a centered position relative to the seat back 12 by upper and lower cross bars 36, 38, each end of which terminates in a forwardly extending attachment flange 40 *a, b* that is coupled to the seat back. A pair of resilient C-clips 42, 44, are secured to the base members at vertically spaced apart positions along the back plate 30.

A pair of strap-supporting arms 46 *a, b* is provided at opposite ends of the upper cross bar 36. Each arm 46 includes relatively rigid lower and upper portions 48 and 50 joined to one another by a resilient central portion or spring 52. The lower portion 48 includes a proximal end 49 that extends through dowels 51 or other fasteners that project laterally outwardly from one of the attachment flanges 40 of the bracket assembly. The upper portion 50 includes a free distal end 54 that is preferably rounded and either formed of or covered by a relatively soft material to reduce the risk of injury to passengers of the emergency vehicle. In addition, the distal end 54 is somewhat larger in diameter than the rest of the arm 46 to limit forward motion of a shoulder strap 24 supported on the arm 46. Rearward motion of the strap 24 is limited by an annular stop collar 56 that projects annularly outwardly from the arm 46 at a location intermediate the spring 52 and the distal end 54.

Figure 2:
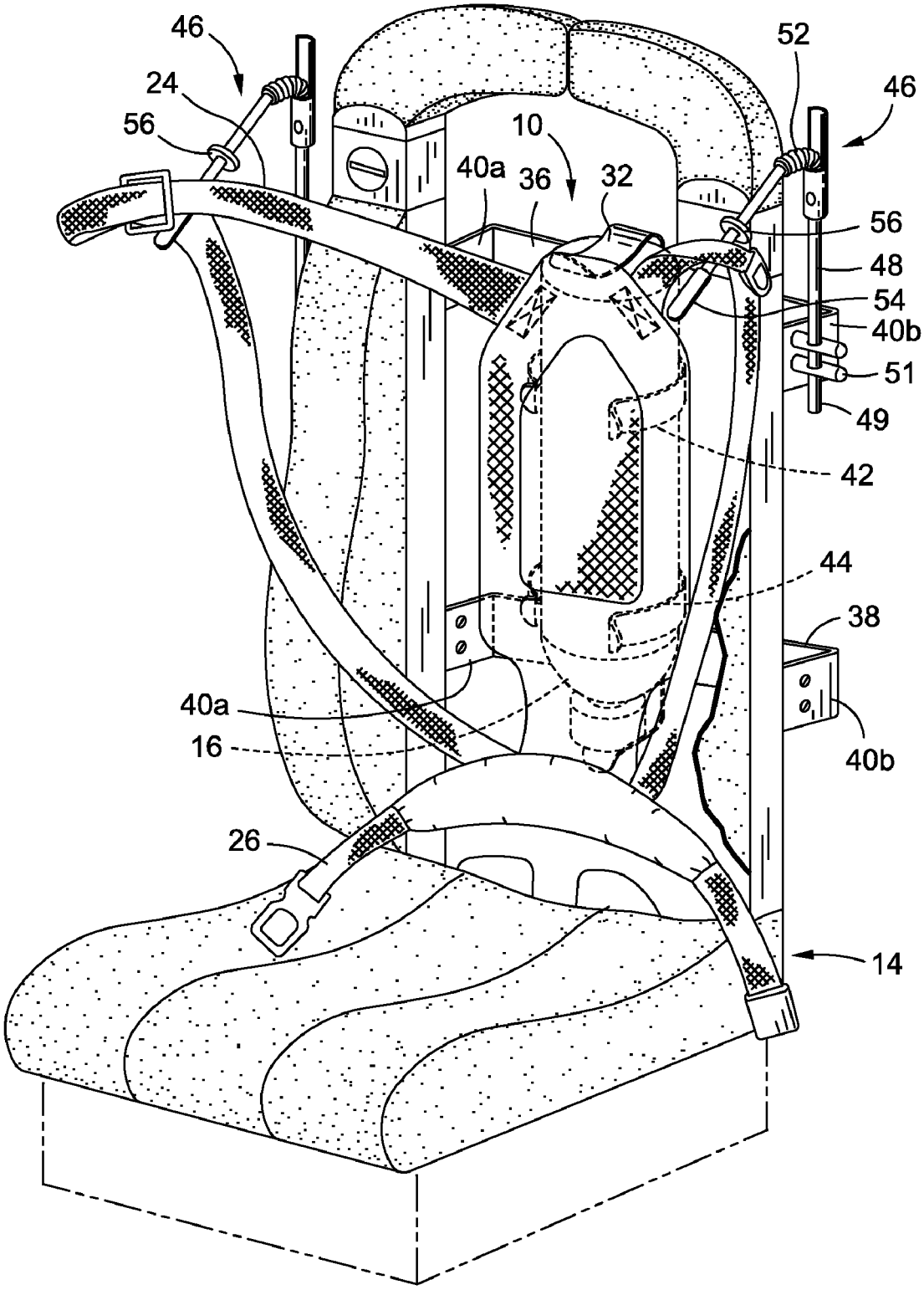
FIG. 2 is a perspective view similar to FIG. 1, with the strap-supporting arms in a working position.

FIG. 2 shows the bracket assembly 10 in its "working" configuration. The tank 16 of an SCBA apparatus 18 has been inserted into the C-Clips 42, 44 in an "upside-down" configuration, so that the neck of the tank 16 is supported by the bottom plate 34, and the bottom of the tank abuts the top plate 32. The shoulder straps 24 of the SCBA harness 20 have been positioned between the stop collar 56 and distal end 54 of each strap-supporting arm 46, and the rest of the SCBA hangs below, exerting sufficient force on each arm 46 to cause the upper portion 50 to bend downwardly approximately 90°, thus holding the straps 24 in a outstretched "ready-to-wear" position that enables a firefighter to easily slip his arms into the harness 18.

Once an emergency worker has put his arms through the shoulder straps 24, he needs only to lean forward slightly to clear the distal ends 54 of the strap-supporting arms 46. This allows the upper portions 50 of the arms 46 to snap upwardly to the rest position shown in FIG. 1. The worker can then continue to fasten the harness 18 around his shoulders and waist while the vehicle is en route to its destination. When the vehicle stops, he can exit quickly and safely, without obstruction from the strap-supporting arms.

Various other modifications and variations to the embodiment herein chosen for purposes of illustration will readily occur to those skilled in the art. For instance, the invention can very easily be adapted for use in fields other than fire-fighting or rescue work, and the C-shaped clips can be replaced or modified to accommodate objects other than cylindrical tanks. To the extent that such variations and modifications do not depart from the spirit of the invention, they are intended to be included within the scope thereof which is assessed only by a fair interpretation of the following claims.

Having fully described and disclosed the instant invention and a preferred embodiment thereof in such clear and concise terms as to enable those skilled in the art to understand and practice the same, the invention claimed is:

1. A bracket assembly for detachably retaining a body-carried device having shoulder straps, the bracket comprising:

a) a base member for attachment to a suitable surface, the base member including a vertically extending back plate having an upper end, a lower end, and a pair of side edges extending between the upper and lower ends;

b) clip means extending from the base member for holding the device in an accessible position;

c) strap-supporting means extending from the base member for holding the shoulder straps in a ready-to-wear position, at least a portion of the strap-supporting means being movable from a rest position generally parallel to the base member to a working position generally perpendicular to the base member, the strap-supporting means comprising a pair of horizontally spaced-apart arms, each arm having a proximal end positioned near a side edge of the back plate and a free distal end extending upwardly with respect to the proximal end when the supporting means is in the rest position; and d) biasing means for resiliently urging the movable portion of the strap-supporting means toward the rest position wherein the biasing means comprises a resilient section in each arm that is sufficiently flexible to allow the distal end of the arm to be pivoted downwardly approximately 90° in response to a gravitational force exerted on it by the body-carried device, and to return automatically to its original rest position when the body-carried device is removed from the assembly.

2. A bracket assembly according to claim 1, further comprising means for securing the base member within a hollow seat back in an emergency vehicle.

3. A bracket assembly according to claim 1, wherein the distal end of each arm is configured to prevent the strap from sliding forwardly off the arm.

4. A bracket assembly according to claim 1, further comprising stop means on each arm for limiting rearward movement of the strap.

5. A bracket assembly according to claim 4, wherein the stop member comprises an annular collar located between the resilient section and the distal end of the arm.

6. A bracket assembly according to claim 1, wherein the body-carried device comprises a cylindrical tank, and the clip means comprises at least one resilient, C-shaped clip for partially encircling the tank.

7. A bracket assembly for detachably retaining a body-carried device having shoulder straps, the bracket comprising:

a) a base member for attachment to a suitable surface, the base member including a vertically extending back plate having an upper end, a lower end, and a pair of side edges extending between the upper and lower ends;

b) clip means extending from the base member for holding the device in an accessible position;

c) strap-supporting means extending from the base member for holding the shoulder straps in a ready-to-wear position, at least a portion of the strap-supporting means being movable from a rest position generally parallel to the base member to a working position generally perpendicular to the base member, the strap-supporting means comprising a pair of horizontally spaced-apart arms, each arm having a proximal end positioned near a side edge of the back plate and a free distal end extending upwardly with respect to the proximal end when the supporting means is in the rest position;

d) stop means on each arm for limiting rearward movement of the strap; and e) biasing means for urging the movable portion of the strap-supporting means toward the rest position.

* * * * *